US005826795A

United States Patent [19]

Holland et al.

[11] Patent Number: 5,826,795

[45] Date of Patent: Oct. 27, 1998

[54] SPRAY ASSEMBLY

[75] Inventors: Lowell W. Holland, St. Paul Park; Alan G. McKown, Oakdale; Constantin I. Ruta, White Bear Lake; Robert M. Petrie, Plymouth, all of Minn.

[73] Assignee: Minnesota Mining and Manufacturing Company, St. Paul, Minn.

[21] Appl. No.: 699,413

[22] Filed: Aug. 19, 1996

[51] Int. Cl.[6] ..... B05B 7/30

[52] U.S. Cl. ..... 239/318; 239/340; 239/354; 239/416

[58] Field of Search ..... 239/310, 318, 239/340, 369, 416, 417.5, 349, 433, 434, 354

[56] References Cited

U.S. PATENT DOCUMENTS

| | | | |
|---|---|---|---|
| 3,090,564 | 5/1963 | Gilmour | 239/318 |
| 3,539,111 | 11/1970 | Johnson | 239/318 |
| 3,608,829 | 9/1971 | Forsman | 239/318 |
| 3,632,046 | 1/1972 | Hengesbach | 239/318 |
| 4,595,127 | 6/1986 | Stoody | 222/135 |
| 4,971,251 | 11/1990 | Dobrick et al. | 239/346 |
| 5,054,687 | 10/1991 | Burns et al. | 239/373 |
| 5,193,748 | 3/1993 | Wittersheim et al. | 239/337 |

FOREIGN PATENT DOCUMENTS

| | | | |
|---|---|---|---|
| 0 720 869 A2 | 7/1996 | European Pat. Off. | B05B 12/00 |
| 3501 446 A1 | 7/1986 | Germany | B05D 1/02 |
| WO 91/16138 | 10/1991 | WIPO | B05B 7/30 |
| WO 97/03758 | 2/1997 | WIPO | B05B 7/24 |

*Primary Examiner*—Andres Kashnikow
*Assistant Examiner*—Lisa Ann Douglas
*Attorney, Agent, or Firm*—William L. Huebsch

[57] ABSTRACT

A spray assembly including a venturi type spray nozzle, a valve attached to the spray nozzle, a reservoir adapter that can engage a reservoir containing a liquid coating material to be sprayed, and a flexible hose between tile reservoir adapter and the valve. The outer surface texture of material being coated can be adjusted using the valve which is useful in matching the surface texture of chip resistant coatings and undercoatings on an automobile, and the hose allows the operator to spray material onto a substrate from any orientation of the spray nozzle which facilitates coating locations such as the lower portions of panels or in wheel wells and trunks. A valve passageways is shaped to facilitate fine adjustment of the air/coating material ratio when small amounts of material are being delivered, and the valve includes an air purge to remove material from the valve and nozzle when the valve is shut off.

12 Claims, 6 Drawing Sheets

SPRAY ASSEMBLY

TECHNICAL FIELD

The present invention relates to assemblies used to spray coatings of materials onto substrates, and in particular to such assemblies that provide rough surface textures on the materials sprayed on the substrates.

BACKGROUND

Various automobiles have chip resistant coatings on the lower portions of their body panels that were applied over the printer layer and under the paint. These chip resistant coatings resist chipping of paint on the automobiles as a result of objects such as gravel striking, the panels during use of the automobile. Such chip resistant coatings all have outer surface textures that are generally rough when compared to the surface of the paint on the rest of the automobile, however the degree of outer surface roughness on such coatings is significantly different on different makes and models of automobiles. When an automobile is repaired by re-surfacing or replacing a body panel (e.g., a door a fender) it is desirable to apply chip resistant coating to that panel that has the same outer surface texture as that of the chip resistant coating on the rest of the automobile. With the application assemblies available heretofore, however, it has been difficult for the craftsman applying such a chip resistant coating to adjust its outer surface texture to match that of the chip resistant coating on the rest of the automobile.

Automobiles also typically have coatings of undercoating materials on the inner surfaces of their body panels to protect the surfaces of those panels from corrosion and for sound deadening purposes. Such coatings of undercoating materials also have outer surface textures that are generally very rough, and differ in roughness between the different makes and models of automobiles. When an automobile is repaired it may be desirable to apply such coatings of undercoating material with the same outer surface texture as that of the undercoating material on the rest of the automobile, particularly in areas that may be more readily observed, such as in the trunk or wheel wells of the automobile. With the application assemblies available heretofore, however, it has been difficult for the craftsman applying such a coating, of undercoating material to adjust its outer surface texture to match that on the rest of the automobile.

Known devices used for applying chip resistant coatings or coatings of undercoating materials draw the coating materials through a dip tube from a container of the coating material carried on the applicator which adds bulk to the applying device. This also requires the craftsman to only use the applicator with the container projecting generally downwardly so that the coating material in the container will be drawn into the dip tube, thereby limiting the positions from which the coating material can be applied.

Known devices used for applying chip resistant coatings or coating of undercoating, materials that are at least partially reusable have either been difficult to clean or purge, or have gone to the expense of using disposable parts so that clean up or purging is not required, and totally disposable aerosol spray devices are often used.

DISCLOSURE OF INVENTION

The present invention provides a spray assembly for applying coatings, such as a chip resistant coating or a coating of undercoating material, which spray assembly (1) is easily adjustable to change the surface texture of the coating being applied to match that of other coatings on the automobile, (2) does not need to carry the supply of coating material being applied on the portion of the assembly being manipulated by the operator, (3) allows the operator to use the portion of the assembly manipulated by him in any orientation to apply the coating, and (4) is easily purged after use so that disposable parts are not required.

In the spray assembly according to the present invention there is provided a spray nozzle having an inlet end adapted to be coupled to a source of air under pressure, a through passageway between that inlet end and an outlet end which has a portion of reduced diameter, and a suction passageway intersecting the through passageway adjacent its portion of reduced diameter. The assembly also includes a valve attached to the spray nozzle. A valve body for the valve has an outlet passageway communicating between a socket and the suction passageway, and an inlet passageway also communicating with the socket. A moveable member is mounted in the socket for movement between open and closed positions through intermediate positions. The moveable member has a connectable passageway adapted to connect between the inlet and outlet passageways in the open and intermediate positions, and to be spaced from at least one of the inlet and outlet passageways in the closed position so that the moveable member blocks communication between those passageways. Decreasing portions of the cross sectional areas of the passageways are connected at the interface between the valve body and the moveable member during movement of the moveable member through its intermediate positions from its open position toward its closed position. The assembly also includes a reservoir adapter adapted to engage a reservoir containing a liquid coating material to be sprayed with the liquid material at an opening through the adapter, and a flexible hose connected between the through opening in the reservoir adapter and the inlet passageway in the valve body. When the inlet end of the spray nozzle of this assembly is then attached to and supported on a hand held air gun attached by a hose to a source of air under pressure (i.e., an air supply gun sold under the trade designation "3M No Cleanup Applicator gun", "Part Number 051135-08801" by Minnesota Mining and Manufacturing Company, St. Paul, Minn.) it can be used to spray the coating material onto a surface. The outer surface texture or roughness of the material being coated can be adjusted by moving the movable valve member to change the ratio between the air and the material being dispensed. Because the material being coated is being drawn through a flexible hose, the operator can use tile hand held air gun and the spray nozzle with the valve attached to it in any orientation to spray material onto a substrate. This facilitates spraying many locations, such as the lower portions or undersides of panels or in wheel wells and trunks on automobiles.

The surface texture of a coating of material applied by the spray assembly is primarily a result of the degree of atomization of the material at the time it impacts the surface being coated, with materials that are more finely atomized producing a coating with a smoother surface texture. The degree of atomization produced by the spray assembly is a result of several variables, including (1) the rheology of the material (e.g., thinner materials are more easily atomized then thicker materials), (2) the inlet pressure of the air passing through the spray nozzle (i.e., the higher the air pressure the finer the atomization), (3) the ratio between the volume of air and the volume of coating material being dispensed from the spray nozzle (the less material dispensed for a given volume of air the finer the atomization), and (4) the distance between the spray nozzle and the surface being coated (the greater the distance the finer the atomization). Known prior art spraying devices for coating materials have only had adjustments on the pressure and, thereby, the volume of air passing through the spray nozzle. The present invention provides the valve assembly which can be used for adjusting the amount of material being drawn into the spray nozzle for any setting of air pressure to the nozzle. This valve assembly greatly facilitates the users ability to select the desired amount of atomization for the material being sprayed. The valve assembly used in the present invention also has a novel structure that facilitates makings fine adjustments in that amount of material being drawn into the spray nozzle. At the interface between the valve body and the moveable member the passageways have cross sectional shapes adapted to increase the angle of rotation required to rotate the rotary member from its open portion through its intermediate positions to its closed position, and to afford more accurate adjustment of the rotary, member to allow small amounts of the material being sprayed to pass through the valve than would be possible if those passageways had circular shapes of the same diameter at their interfaces. This adjustment of the material being sprayed together with the use of chip resistant coatings of two different viscosities (e.g., the chip resistant coatings commercially designated "Part No. 8447 Rocker Coating Smooth" and "Part No. 8448 Rocker Coating Coarse" soon available from Minnesota Mining and Manufacturing Company (3M), St. Paul, Minn.) affords duplicating the surface texture on the factory applied chip resistant of many different 1996 model automobiles including the "Corola" (T.M.), "Tercel" (T.M.), and "T-100" (T.M.) pickup models made by Toyota which have a very smooth surface texture; the "Trooper" (T.M.) made by Isuzu and the "Impreza" (T.M.) made by Suburu which have smooth; surface textures, the "Taurus" (T.M.) sedan and wagon and the "Escort" (T.M.) sedan and wagon made by the Ford Motor Company which have medium surface textures, and the "B3000" (T.M.) made by Mazada, the "Targa" (T.M.) made by Porsche, the "Passat" (T.M.) made by Volkswagon, and the "E300" (T.M.) made by Mercedes which have coarse surface textures.

Also, the spray assembly is easily purged of the material being sprayed after use. The moveable member has an air inlet passageway having inlet and outlet openings through the surface of the moveable member positioned so that in the closed position of the moveable member the inlet opening is open to the atmosphere and the outlet opening communicates with the outlet passageway in the valve body. Air under pressure moved through the spray nozzle will then pull air through the air inlet passageway, and expel any material remaining in the outlet passageway so that the assembly will be purge for future use. This air purging feature also makes the spray assembly useful to coat materials for which the surface texture of the applied coating is unimportant, such as intercavity coatings, sprayable putties, weld through coatings, overspray masking liquids, and the like.

A plurality of the spray assemblies can be supported on a carrying tray including a platform supporting reservoirs for the spray assemblies, and a support member adapted to Support their spray nozzles and valves. The reservoirs of the spray assemblies can contain any of the different coating materials that a craftsman may use in repairing an automobile (e.g., different chip resistant coatings which may be of different viscosities, different undercoating materials that may have solvent or water bases; an inter cavity coating, a sprayable putty, a weld through coating, an overspray masking liquid, and/or a bumper coating). The craftsman can carry the carrying tray to his work place and have available those various coatings needed to complete repair of an automobile.

BRIEF DESCRIPTION OF THE DRAWINGS

The present invention will be further described with reference to the accompanying drawing wherein like reference numerals refer to like parts in the several views, and wherein.

DETAILED DESCRIPTION

Figure 1:
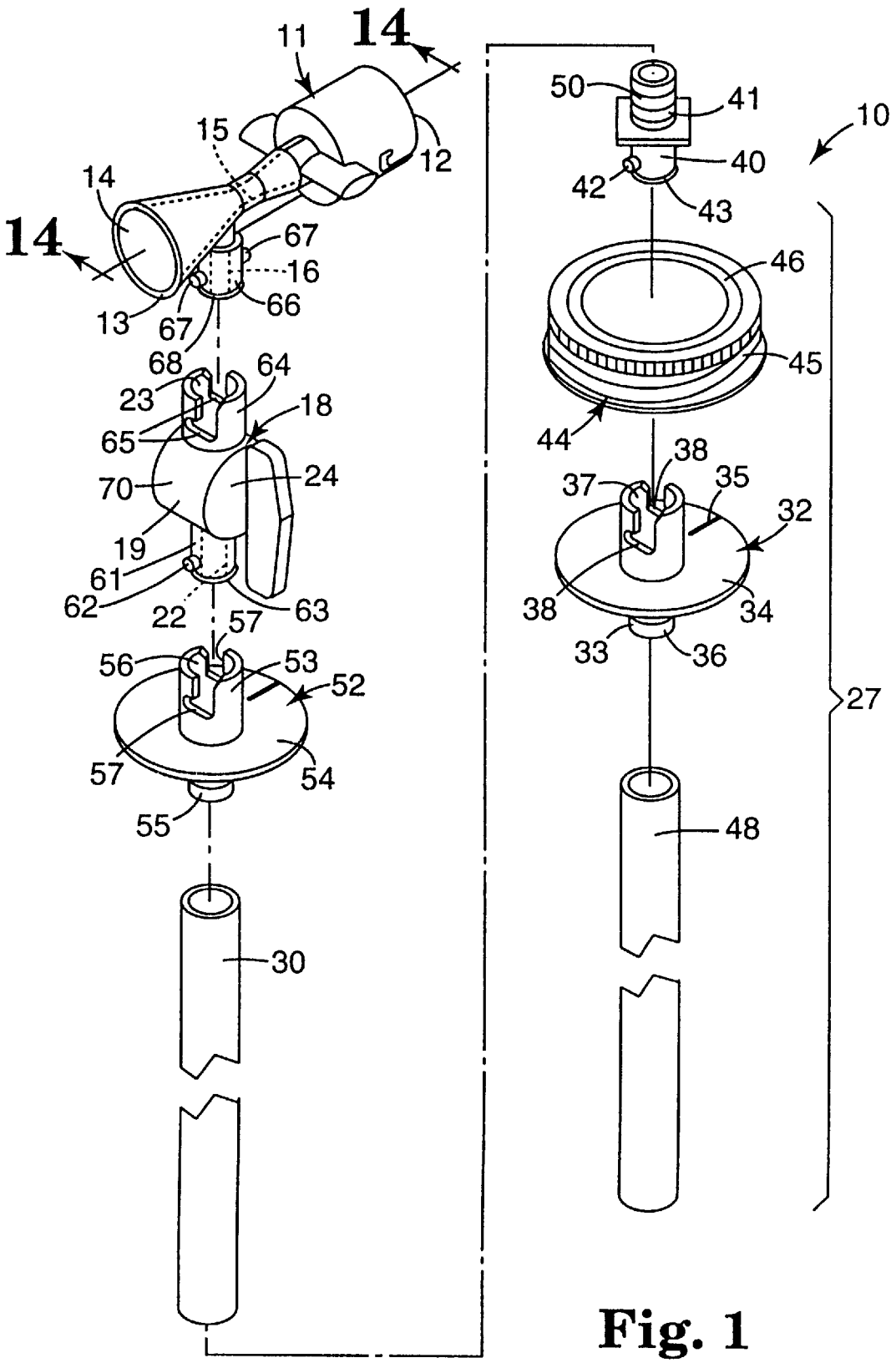
FIG. 1 is an exploded perspective view of a spray assembly according to the present invention.
Figure 2:
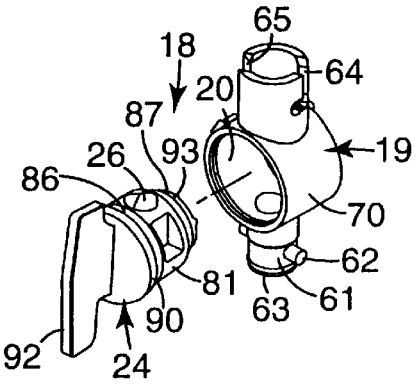
FIG. 2 is an exploded perspective view of a valve included in the spray assembly of FIG. 1.
Figure 7:
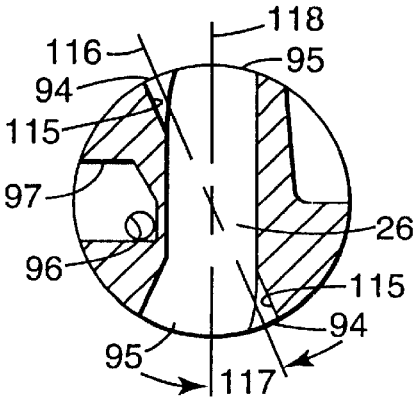
FIG. 7 is a sectional view taken approximately along line 7—7 of FIG. 5.
Figure 3:
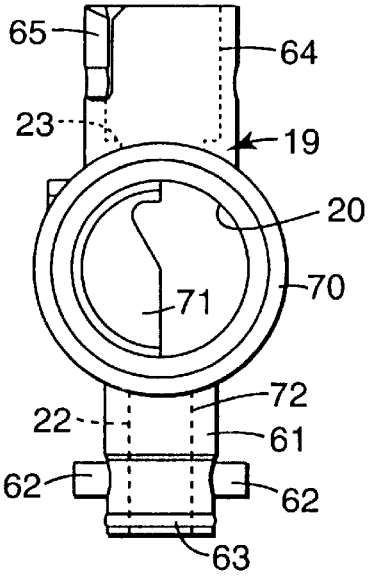
FIG. 3 is a front view of a valve body included in the valve illustrated in FIG. 2.
Figure 4:
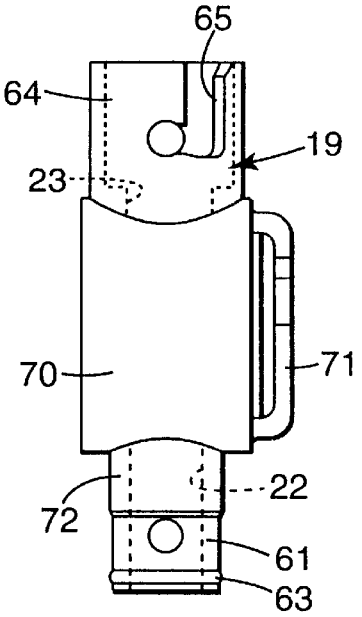
FIG. 4 is a side view of the valve body illustrated in FIG. 3.
Figure 5:
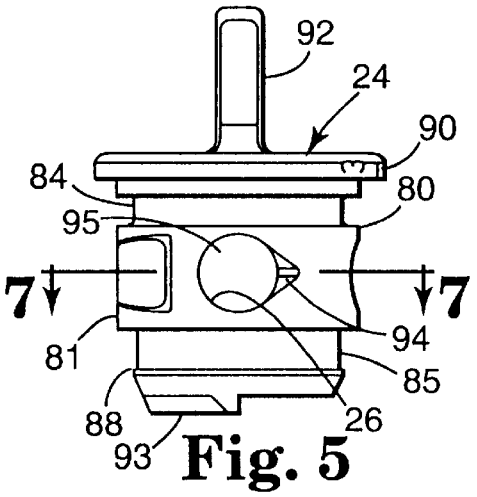
FIG. 5 is a top view of a movable member included in the valve illustrated in FIG. 2.
Figure 6:
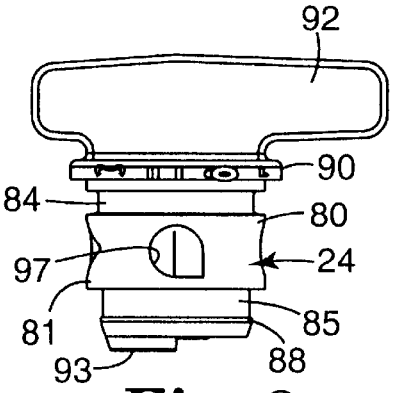
FIG. 6 is a side view of the movable member illustrated in FIG. 5

Referring now to FIG. 1 of the drawing, there is shown a spray assembly according to the present invention generally designated by the reference numeral 10.

Figure 15:
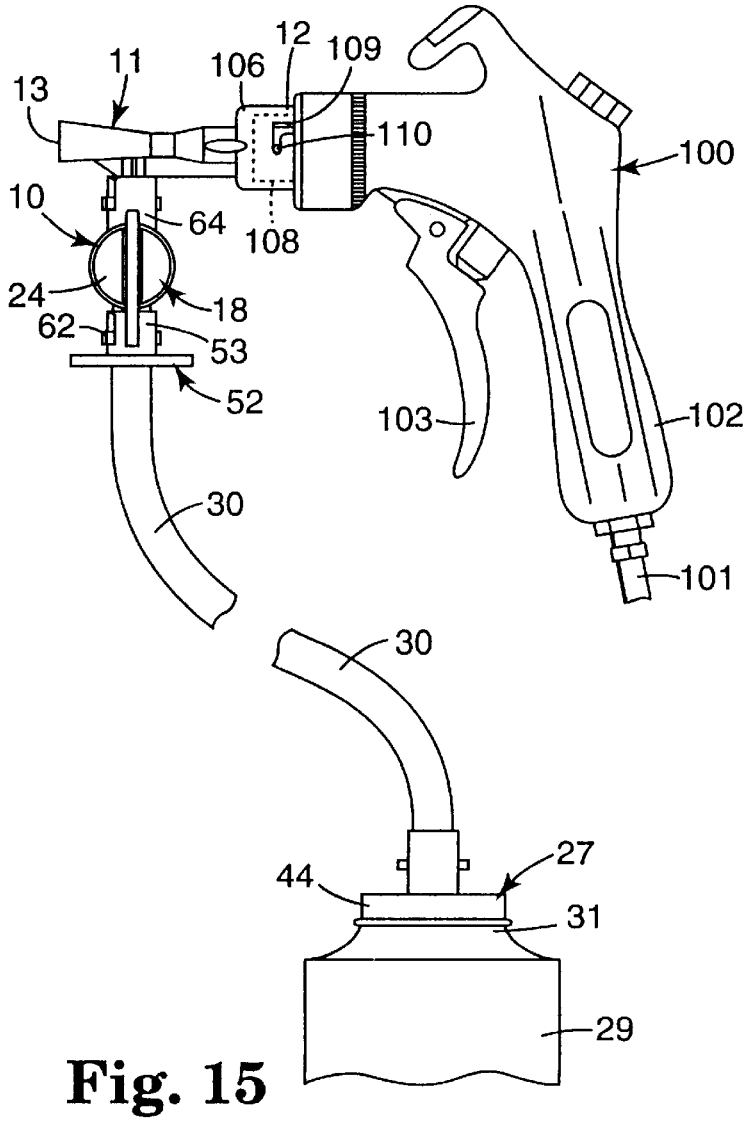
FIG. 15 is a fragmentary side view showing the spray assembly of FIG. 1 coupled to an air gun and to a reservoir.

Generally the spray assembly 10 comprises a venturi spray nozzle 11 having an inlet end 12 adapted to be coupled to a source of air under pressure, an outlet end 13, and a through passageway 14 between its ends 12, 13. The through passageway 14 has a portion 15 of reduced passage diameter between the ends 12, 13, and the spray nozzle includes a suction passageway 16 intersecting the through passageway 14 adjacent that portion 15 of reduced passage diameter in which a vacuum will be formed when air under pressure moves through the passageway 14. Also included in the spray assembly 10 is a valve 18 comprising a valve body 19 attached to the spray nozzle 11 that has a socket 20, and has separate inlet and outlet passageways 22 and 23 communicating with the socket 20, with the outlet passageway 23 communicating between the socket 20 and the suction passageway 16. A moveable or rotary member 24 is mounted in the socket 20 in the valve body 19 for rotational movement between open and closed positions through intermediate positions between those open and closed positions. The rotary member 24 has a connectable passageway 26 adapted to connect between the inlet and outlet passageways 22 and 23 in the open and intermediate positions, and to be spaced from the inlet and outlet passageways 22 and 23 in the closed position so that the rotary member 24 blocks communication between the inlet and outlet passageways 22 and 23 in the valve body 19, and to have decreasing portions of the cross sectional areas of the passageways 22, 23, 26 connected at the interface between the valve body 19 and the rotary member 24 during movement of the rotary member 24 through the intermediate positions from the open position toward the closed position The assembly 10 also includes a reservoir adapter 27 having a through opening that is adapted to engage a reservoir 29 (FIG. 15) containing a liquid coating material to be sprayed with the liquid coating material at the through opening 28, and a flexible hose 30 having a through opening connected between the reservoir adapter 27 and the valve body 19 with the through opening in the hose 30 communicating between the through opening in the reservoir adapter 27 and the inlet passageway 22 in the valve body 19.

The reservoir adapter 27, as illustrated, is adapted to engage a standard 1 and ¾ inch diameter externally threaded collar 31 that forms an opening for the reservoir or one quart container 29. As is best seen in FIG. 1, the adapter 27 includes a main portion 32 including a first short hollow cylindrical tube 33 co-axially at its center, a radially outwardly projecting flange 34 about midway alone the length of the first tube 33 that is adapted to rest on the distal end of the threaded collar 31 and has a radial vent slot 35 that provides a vent for the container 29, a hose bib 36 formed around the periphery of the first tube 33 at one end, and walls defining a socket 37 in the first tube 33 at it's other end. Those walls have L-shaped slots 38 and are adapted to provide half of a bayonet coupling that releasably engages an end portion 40 of a second tube 41. That end portion 40 of the second tube 41 has radially outwardly protecting pins 42 adapted to engage surfaces of the walls defining, the L-shaped slots 38 in a conventional manner by first sliding, the pins 42 axially into axially aligned portions of the slots 38 and then rotating the first and second tubes 33 and 41 relative to each other to cause the pins 42 to firmly cam into circumferentially extending portions of the slots 38 at which they are retained by a detent between the pins 42 and the walls defining, the slots 38, and the end portion 40 has a distal end formed with an annular radially outwardly projecting ridge 44 adapted to seal against the inner surface of the socket upon engagement of the pins 42 against the surfaces defining, the L-shaped slots 38. A circular metal collar 44 included in the reservoir adapter 27 has an internally threaded cylindrical portion 45 adapted to engage the threads on the flange of the container, and a radially inwardly extending portion 46 adapted to bear against and press the flange 34 against the end of that collar 31 when the cylindrical portion 45 is so engaged. The reservoir adapter 27 also includes a hollow cylindrical dip tube 48 adapted to reach to the bottom of the container 29 with which the reservoir adapter 27 is engaged, with one end portion of the dip tube 48 engaged over the hose bib 36 formed around the end of the tube 33. While the reservoir adapter 27 illustrated is preferred for many purposes, the spray assembly 10 could alternatively include any reservoir adapter that serves to provide a supply of the liquid coating material to be sprayed at the end of the hose 30 opposite the valve 18.

One end of the hose 30 is engaged over a hose bib 50 formed around the end of the second tube 41 opposite its end portion 40. The end of the hose 30 opposite the second tube 41 is coupled to the valve 18 by a coupler 52 that, to save making a different part, has the same structure as the main portion 32 of the adapter 27 described above. The coupler 52 includes a first short hollow cylindrical tube 53 co-axially at its center, a radially outwardly projecting flange 54 about midway along the length of the first tube 53 that can be grasped to engage the coupler 52, a hose bib 55 formed around the periphery of the first tube 53 at one end, and a wall of the first tube 53 at it's other end that defines L-shaped slots 57 and a socket 56 opening through its distal end that provide half of a bayonet coupling that releasably engages an end portion of a tube 61 defining, the inlet passageway 22 that is formed on the valve body 19. That end portion of the tube 61 on the valve body 19 has radially outwardly projecting pins 62 adapted to engage surfaces of the walls defining, the L-shaped slots 57 in a conventional manner as described above, and an annular radially outwardly projecting ridge 63 around its distal end that will seal against the inner surface of the socket 56 when the pins 62 engage the surfaces defining the L-shaped slots 57. Similarly a tube 64 on the valve body 19 defining the outlet opening 23 includes a wall defining L-shaped slots 65 and a socket that open through its distal end to provide half of a bayonet coupling that releasably engages an end portion of a tube 66 formed on the spray nozzle 11 that defines the suction passageway 16. That end portion of the tube 66 on the valve body 19 has radially outwardly projecting pins 67 adapted to engage surfaces of the walls defining the L-shaped slots 65 in a conventional manner as described above, and has an annular radially outwardly projecting ridge 68 at its distal end that is adapted to seal against the inner surface of the socket when the pins 67 are engaged with the surfaces defining, the L-shaped slots 65.

The valve body 19 (see FIGS. 1, 2, 3, and 4) and moveable or rotary member 24 (see FIG. 1, 2, 5, 6 and 7) of the valve 18 are both injection molded of a polymeric material (e.g., polypropylene) The valve body 19 includes a hollow cylindrical portion 70 defining the socket 20 which is also generally cylindrical, a partial end wall 71 across one end of the socket 20, and the opposite outwardly projecting portions 61 and 64 which define the axially aligned inlet and outlet passageways 22 and 23, respectively. The rotary member 24 includes a generally cylindrical portion 80 including a central part 81 with a cylindrical peripheral surface adapted to fit closely with a portion of the inner surface defining the socket 20 and through which the connectable passageway 26 radially extends. The rotary member 24 has annular grooves 84 and 85 flanking the central part 81 around which O ring seals 86 and 87 extend to provide a seal with the inner surface of the cylindrical portion 70, and a ridge 88 at one end adapted to engage a recess around the surface defining the socket 20 to retain the rotary member 24 in the socket 20. The rotary member 24 also has a radially projecting ridge 90 around its end opposite the ridge 88 that is positioned along one end of the cylindrical portion 70 and a transverse handle portion 92 projecting beyond the cylindrical portion 80 that can be manually engaged to rotate the rotary member 24 with respect to the valve housing 19 between its closed and open positions. The rotary member 24 also has radially extending ridges 93 disposed in a V-shaped pattern and projecting, from its end opposite the handle 92 that are adapted to abut an edge of the partial end wall 71 and limit rotation of the rotary member 24 between its open and closed positions.

Figure 11:
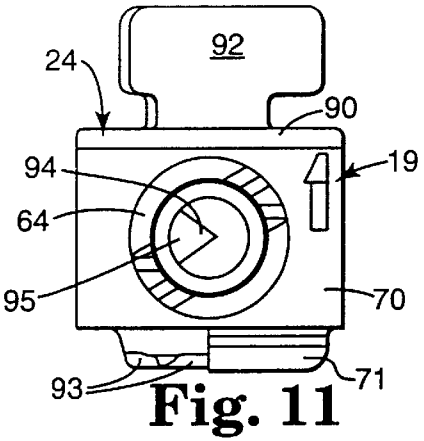
FIG. 11 is a top view of the valve as illustrated in FIG. 10.
Figure 9:
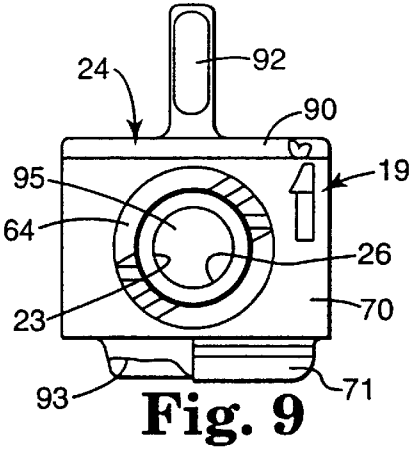
FIG. 9 is a top view of the valve as illustrated in FIG. 8.
Figure 8:
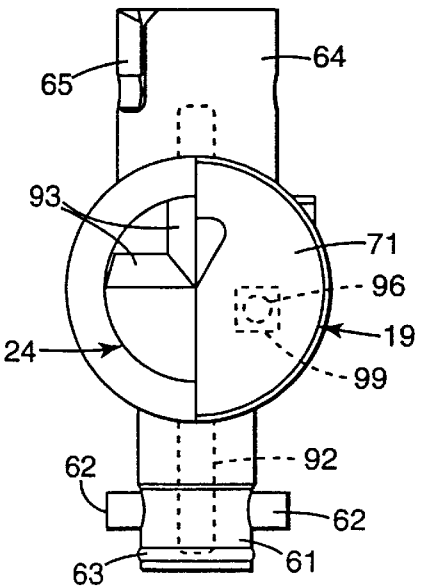
FIG. 8 is a rear view of the valve illustrated in FIG. 2 when the valve is assembled and the movable member is in an open position.

At their interfaces between the valve body 19 and the rotary member 24 the inlet and outlet passageways 22 and 23 are circular, and the opposite ends of the connectable passageway 26 (see FIG. 5 and 7) have non-circular elongated shapes tapered at one end that are adapted to increase the angle of rotation required to rotate the rotary member 24 from its open portion through its intermediate positions to its closed position, and to afford more accurate adjustment of the rotary member to allow small amounts of the material being sprayed to pass through the valve than would be possible if the opposite ends of the connectable passageway 26 had circular shapes of the same diameter as the inlet and outlet passageways 22 and 23. The opposite ends of the connectable passageway 26 have circular portions 95 of the same diameter as the inlet and outlet passageways 22 and 23 which align with the inlet and outlet passageways 22 and 23 when the rotary member 24 is in its open position with respect to the valve body 19 (see FIGS. 8 and 9). The opposite ends of the connectable passageway 26 also have V shaped portions 94 at the ends of V-shaped grooves similar in shape to the pour spout on a pitcher, which V-shaped grooves are on opposite sides at its opposite ends (see FIGS. 5 and 7). As the rotary member 24 is rotated through its intermediate positions toward its closed position first both a portion of its circular portion 95 and its V-shaped portion 94 will be in communication with the circular inlet and outlet passageways 22 and 23 as can be seen in FIG. 11. Subsequently only the V-shaped portions 94 will be in communication with the circular ends of the inlet and outlet passageways 22 and 23, and the areas of the pairs of the V-shaped portions in communication will diminish linearly a the rotary member 24 is moved to its closed position. The V-shaped portions 94 thus elongate the openings at the ends of the connectable passageway 26 to extend the amount of rotation needed to move the rotary member 24 to its closed position, and decrease the rate at which the ends of the connectable passageway 26 move out of alignment with the ends of the inlet and outlet passageways 22 and 23 compared to the use of a connectable passageway 26 with circular ends of the same diameter as the ends of the inlet and outlet passageways 22 and 23 These V-shaped grooves 94 thus facilitate fine adjustment by the craftsman of the amount of material moving into the nozzle 11, potentially resulting in a better match of the surface texture of the material being coated with the surface texture that the craftsman desires to match. While the V-shaped portions 94 illustrated are preferred because of their simplicity and ease of formation, other shapes could be used to replace the V-shaped portions 94, such a W shape or a half oval shape with a long width to height ratio. Also, alternatively the opposite ends of the connectable passageway 26 could be circular and the inlet and outlet passageways 22 and 23 could have non-circular elongated shapes tapered at one end at their interfaces with the rotary member 24 that are adapted to increase the angle of rotation required to rotate the rotary member 24 from its open portion through its intermediate positions to its closed position, and which afford more accurate adjustment of the rotary member 24 to allow small amounts of the material being sprayed to pass through the valve 18 than would be possible if the inlet and outlet passageways 22 and 23 had circular shapes of the same diameter as the connectable passageway 26 at those interfaces.

Figure 14:
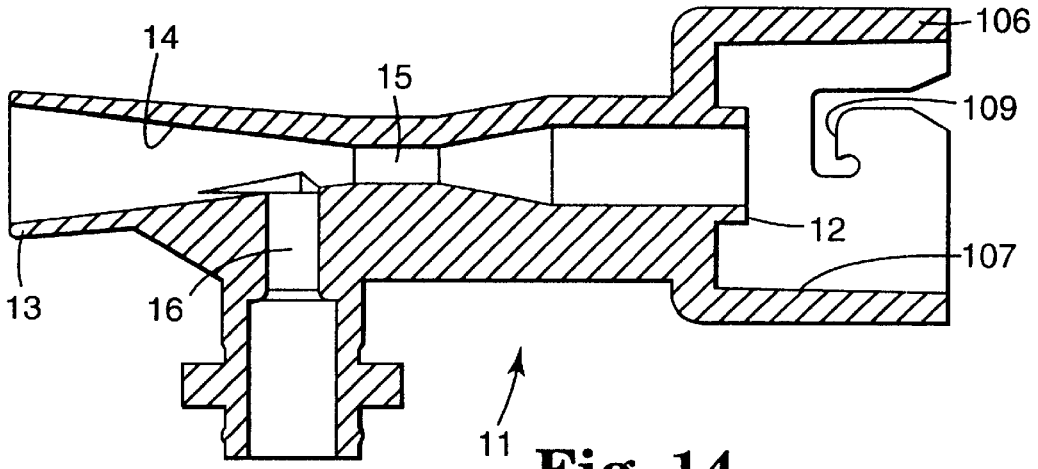
FIG. 14 is a Cross sectional view taken approximately along line 14—14 of FIG. 1.
Figure 16:
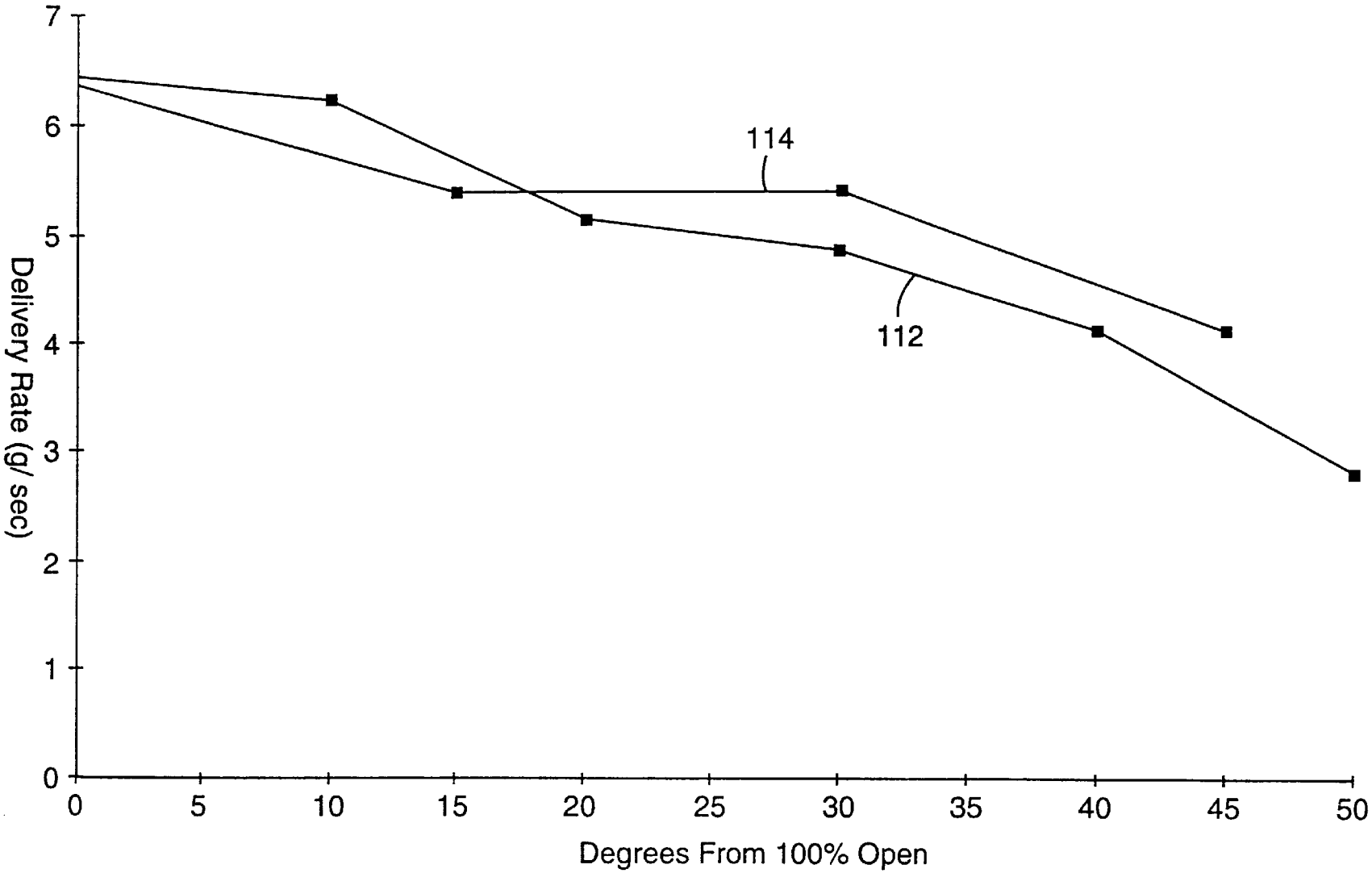
FIG. 16 is a graph showing the results of an experiment performed with the spray assembly according to the present invention.

FIG. 16 graphs the results of an experiment comparing, the use of the connectable passageway 26 that has ends of the shape described above with the use of a connectable passageway that has circular ends of the same diameter as the ends of the inlet and outlet passageways 22 and 23. The venturi spray nozzle 11 used in the experiment, which was shaped as illustrated in FIG. 14, had a 2.068 inches or 5.253 centimeters long passageway 14, which passageway 14 had a cylindrical portion adjacent the inlet end 12 of the nozzle 11 which had a diameter of 0.330 inch or 0.838 centimeter and a length of 0.544 inch or 1.382 centimeters, and had a diameter of 0.347 inch or 0.881 centimeter at the outlet end 13 of the nozzle 11 The portion 15 of reduced passageway diameter in the passageway 14 had a diameter of 0.110 inch or 0.279 centimeter and a length of 0.238 inch or 0.605 centimeter, the suction passageway had a diameter of 0.149 inch of 0.378 centimeter and was spaced 0.793 inch or 2.014 centimeters from the outlet end of the nozzle 11 and 0.166 inch or 0.422 centimeter from the adjacent end of the portion 15 of reduced passageway diameter. The cylindrical portion 80 of the rotary member 24 had a diameter of 0.760 inch or 1.930 centimeters, the inlet and outlet passageways 22 and 23 both had diameters of 0.250 inch or 0.635 centimeter, and the connectable passageway 26 had, at each end, a circular portion 95 with a 0.250 inch or 0.635 centimeter diameter and a V-shaped portion 94 with an apex angle of 67.9 degrees that projected beyond the circular portion 95. The V-shaped portion 94 was at the end of a V-shaped groove, the apex or bottom 115 of which (see FIG. 7) had a 0.015 inch or 0.038 centimeter radius and was parallel to and spaced 0.050 inch or 0.127 centimeter away from an imaginary line 116, which imaginary line 116 passed through the axis of the rotary member 24 and was disposed at an angle 117 of 24 degrees with respect to the centerline or axis 118 of the connectable passageway 26. Air under 40 PSI pressure was blown through the passageway 14 and water was sucked through the suction passageway 16 as the rotary member 24 was moved in steps measured in degrees and plotted on the X axis from its open through its intermediate to its closed position. Measurements were made of the rate of delivery of the water at various settings of the rotary member 24 and plotted on the Y axis, resulting in the plot line 112 in FIG. 16. The same experiment was performed using a cylindrical portion that was the same as the cylindrical portion 80 described above except that its connectable passageway had circular ends of 0.250 inch or 0.635 centimeter diameter that did not have V-shaped portions, resulting in the plot line 114 in FIG. 16. As can be seen in FIG. 16, the cylindrical portion that was the same as the cylindrical portion 80 described above except that its connectable passageway had circular ends was rotated by 45 degrees before it was in its closed position, and delivered about 4 and ¼ grams per second of the material just prior to being placed in that closed position, whereas the cylindrical portion 80 described above that had ends with both a circular and V-shaped portions was rotated by 50 degrees before it was in its closed position, and delivered about 3 and ¼ grams per second of the material just prior to being placed in that closed position.

Figure 13:
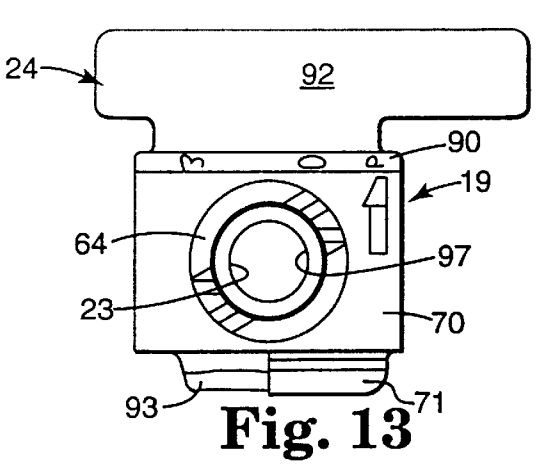
FIG. 13 is a top view of the valve as illustrated in FIG. 12.
Figure 12:
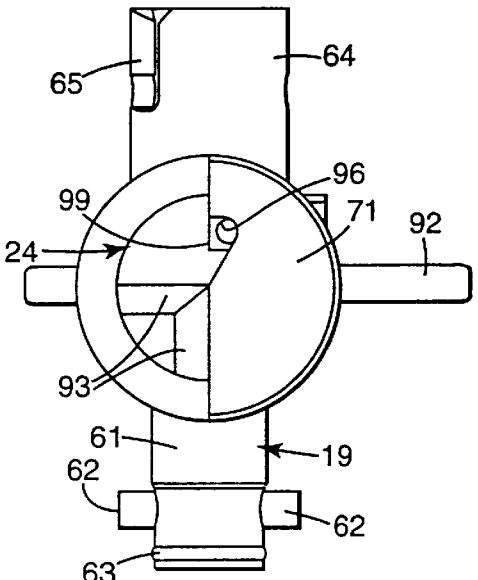
FIG. 12 is a rear view of the valve illustrated in FIG. 2 when the valve is assembled and the movable member is in a closed position.
Figure 10:
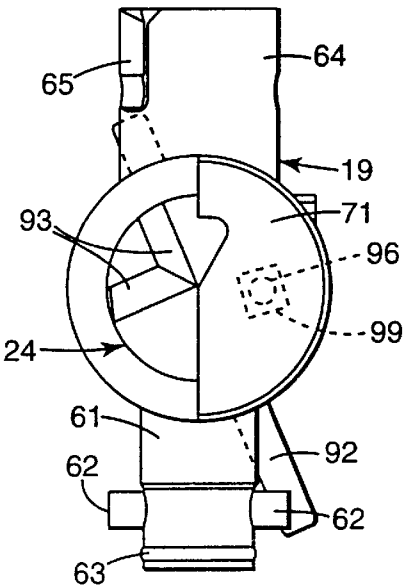
FIG. 10 is a rear view of the valve illustrated in FIG. 2 when the valve is assembled and the movable member is in one of its intermediate positions.

The valve 18 includes means for allowing air to be drawn into the nozzle 11 through the outlet and suction passageways 23 and 16 to purge them of the coating material after the rotary member 24 is moved to its closed position. The rotary member 24 has an air inlet passageway (see FIG. 7) having an inlet opening 96 through the end surface of the rotary member 24 opposite the handle portion 92, and an outlet opening 97 through the central part 81 of the cylindrical portion 80 positioned to communicate with the outlet passageway 23 in the valve body 19 in the closed position of the rotary member 24 (see FIGS. 12 and 13), and to be spaced from the outlet passageway 23 in the valve body 19 in the intermediate and open positions of the rotary member 24. A projecting annular rink 99 around the inlet opening 96 to the air inlet passageway is positioned along the planar inner surface of the partial end wall 71 on the valve body 19 to seal it closed when the rotary member 24 is in its open or intermediate positions (see FIGS. 8 and 10), whereas that inlet opening 96 moves into alignment with an opening along the edge of the partial end wall 71 when the rotary member 24 moves to its closed position (see FIG. 12) so that air can then be drawn into the outlet passageway 23, suction passageway 16, and the nozzle 11 to purge it of coating material.

The venturi spray nozzle 11, best seen in FIGS. 1 and 14, is molded of polymeric material (e.g., polypropylene). The inlet end 12 is adapted to be coupled to an air supply gun 100 (see FIG. 15) sold under the trade designation "3M No Cleanup Applicator gun", "Part Number 051135-08801" by Minnesota Mining and Manufacturing, Company, St. Paul, Minn.). The air supply gun 100, when attached by an air hose 101 to a source of air under pressure, can be manually manipulated by a handle 102 and manually activated by pulling a trigger 103 to propel air under pressure through the passageway 14 in the spray nozzle 11. The suction passageway 16 intersects the through passageway 14 adjacent that portion 15 of reduced passage diameter between that portion 15 of reduced passageway diameter and the outlet end 13 of the nozzle 11, and by venturi action will suck material though the suction passageway 16 into the air stream moving through the through passageway 14. The portion of the nozzle's inlet end 19 adapted to be coupled to the air supply gun 100 includes walls 106 defining a socket 107 adapted to receive a cylindrical projection 108 around an air outlet port on the air gun 100. The walls 106 have L-shaped slots 109 and are adapted to provide half of a bayonet coupling that releasably engages radially outwardly projecting pins 110 on the projection 108 in the conventional manner described above for other bayonet couplings in the spray assembly 10.

If desired, the reservoir adapter 27 with a container 29 filled with material to be sprayed attached thereto can be attached directly to the tube 61 on the valve body 19 by engaging the pins 62 with the slots 38. Alternatively, a package of two part material of the type described in U.S. Pat. No. 4,971,251 (the content whereof is incorporated by reference herein) can be attached directly to the tube 61 or to the tube 40 and used as the supply of the material to be sprayed. Also, the spray nozzle 11 can have an extension tube (not shown) attached to its outlet end to extend the through passageway 14, and that extension tube can be used in places such as between panels in an automobile to apply rust proofing materials, after which both the spray nozzle 11 and that extension tube can be purged of the material being, applied by turning the rotary member 24 to its closed position.

Figure 19:
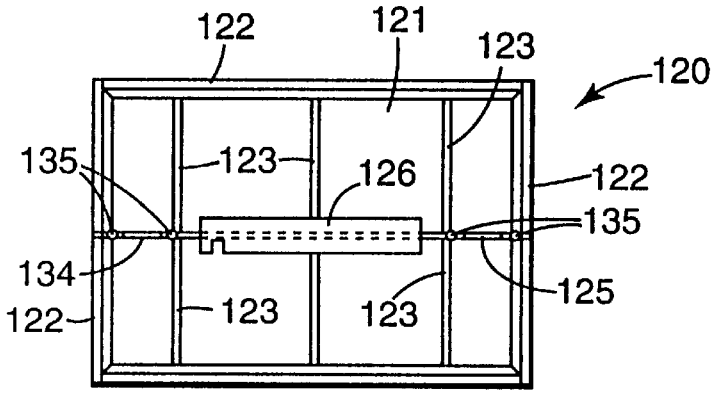
FIG. 19 is a top view of the tray of FIG. 17.
Figure 17:
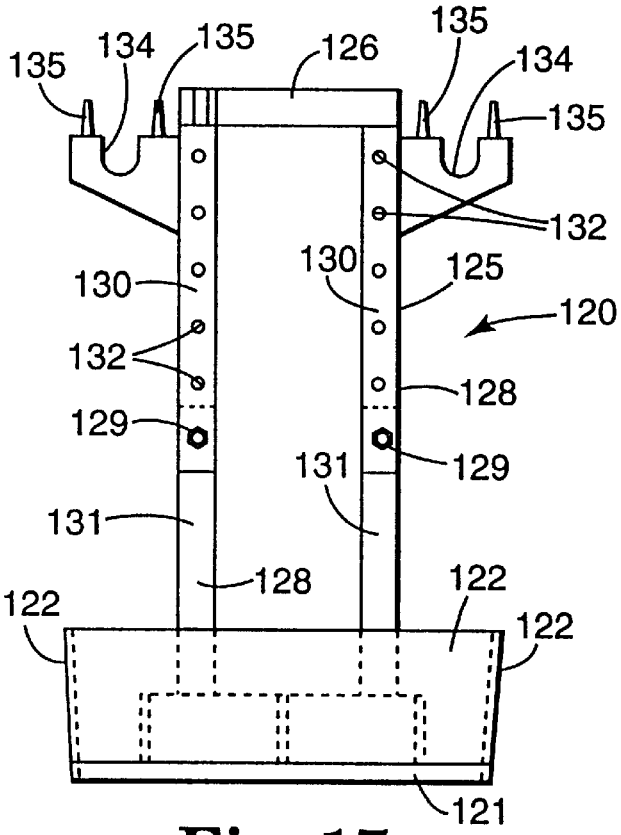
FIG. 17 is a side view of a tray according to the present invention that can be used to support a plurality of the spray assemblies of FIG. 1 after they have been attached to reservoirs.
Figure 18:
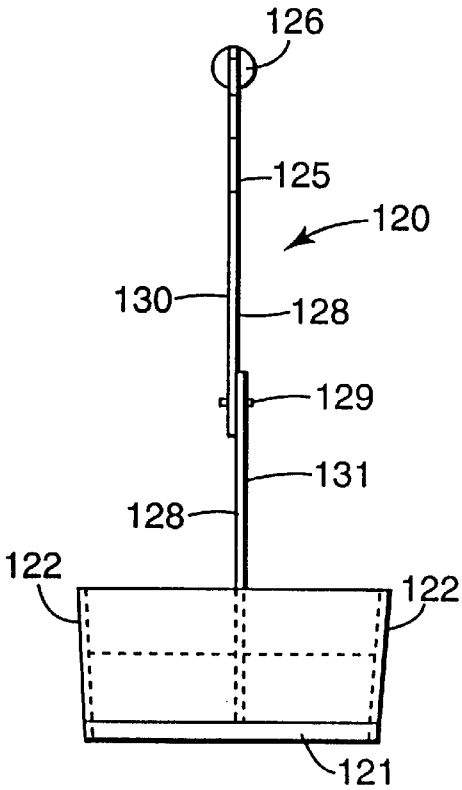
FIG. 18 is an end view of the tray of FIG. 17.

A plurality of the spray assemblies 10 can be supported on a carrying device such as a carrying tray 120 illustrated in FIGS. 17–19 which could be made of wood or molded of polymeric material. That carrying tray 120 includes a platform 121 from which side walls 122 and dividing walls 123 project upwardly to define open top compartments in which a plurality of the reservoirs 29 for the spray assemblies 10 can be received and supported. The carrying tray 120 also includes a support assembly 125 that projects upwardly centrally of tile platform 121. The support assembly 125 includes a transverse handle portion 126 at its upper end adapted for manual engagement to carry the tray 120, and has two parallel support members 128 extending between the platform 121 and the opposite ends of the handle portion 126. The Support members 128 each include two parts 130, 131 and are adjustable in length by inserting fasteners 129 (e.g., bolts or pins) through different pairs of openings 132 along two parts 130, 131 to provide different spacings between the handle portion 126 and the platform 121 that may be desirable to the workman for various reasons, such as to facilitate storage of the carrying tray 120. The Support members 128 also include projecting portions adjacent the ends of the handle portion 126 that include notches 134 and projections 135 adapted to receive and support the spray nozzles 11, valves 18, and hoses 30 of the spray assemblies 10 carried in the compartments in the platform 121. The reservoirs 29 to which the spray assemblies 10 carried in the carrying tray 120 are connected can contain different coating materials that a craftsman may use in repairing an automobile and that can be applied using the spray assemblies 10 (e.g., different chip resistant coatings which may be of different viscosities such as "Part No. 8447 Rocker Coating Smooth" and "Part No. 8448 Rocker Coating Coarse", both soon available from 3M, St. Plau, Minn.; different undercoating materials such as "Part No. 8449 Water Base Undercoat" and "Part No. 8450 Solvent Base Undercoat", both available from 3M St. Paul, Minn., an inter cavity coatings such as "Part No. 8446 Cavity Coating" available from 3M, St. Paul, Minn.; a sprayable putty; a weld through coating, an overspray masking, liquid, and/or a bumper coating). The craftsman can carry the carrying tray 120 and spray assemblies 10 coupled to reservoirs 29 that are supported on it to his work place and have available those various coatings needed to complete the repair of an automobile.

The present invention has now been described with reference to one embodiment and several modifications thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

What is claimed is:

1. A spray assembly comprising:

a spray nozzle having an inlet end adapted to be coupled to a source of air under pressure, an outlet end, a through passageway between said ends, said through passageway having a portion of reduced passageway diameter between said ends, a suction passageway intersecting said through passageway adjacent said portion of reduced passageway diameter;

a valve comprising a valve body attached to said spray nozzle, said valve body having a socket and having separate inlet and outlet passageways, said inlet and outlet passageways having spaced ends communicating with said socket, and said outlet passageway communicating between said socket and said suction passageway, a moveable member mounted in the socket in said valve body for movement between open and closed positions through intermediate positions between said open and closed positions, said moveable member having a connectable passageway having opposite ends adapted to connect between the ends of said inlet and outlet passageways with pairs of said ends in communication in said open and intermediate positions, to be spaced from at least one of the ends of said inlet and outlet passageways in said closed position so that in said closed position said moveable member blocks communication between said inlet and outlet passageways in said valve body, and adapted to have decreasing portions of the areas of said pairs of said ends in communication during movement of said moveable member through said intermediate positions from said open position toward said closed position;

a reservoir adapter having a through opening adapted to engage a reservoir containing a liquid coating material to be sprayed with the liquid coating material at the through opening; and a flexible hose having a through opening connected between the reservoir adapter and the valve body with the through opening in the hose communicating between the through opening in the adapter and the inlet passageway in the valve body.

2. A spray assembly according to claim 1 wherein one of said ends in each of said pairs of ends has a shape adapted to increase the angle of rotation required to rotate the rotary member from its open portion through its intermediate positions to its closed position and to afford more accurate adjustment of the rotary member to allow small amounts of the material being sprayed to pass through the valve than would be possible if those pairs of ends both had circular shapes of the same diameter.

3. A spray assembly according to claim 2 wherein said one of said ends has a circular portion and a generally V-shaped portion projecting at one side of said circular portion.

4. A spray assembly according to claim 1 wherein said moveable member has a through air inlet passageway having an inlet opening through the surface of said moveable member that is open to the atmosphere when said moveable member is in said closed position, and an outlet opening positioned to communicate with said outlet passageway in said valve body in the closed position of said moveable member so that air will be drawn into said outlet passageway, said outlet opening being spaced from said outlet passageway in said valve body in the intermediate and open positions of said moveable member.

5. A spray assembly according to claim 4 wherein said valve assembly includes means for sealing the inlet opening of said air inlet passageway against a surface of said valve body in said intermediate and open positions of said moveable member.

6. A spray assembly comprising:

a spray nozzle having an inlet end adapted to be coupled to a source of air under pressure, an outlet end, a through passageway between said ends, said through passageway having a portion of reduced passageway diameter between said ends, a suction passageway intersecting said through passageway adjacent said portion of reduced passageway diameter;

a valve comprising:

a valve body attached to said spray nozzle, said valve body having a socket and having separate inlet and outlet passageways, said inlet and outlet passageways having spaced ends communicating with said sockets, and said outlet passageway communicating between said socket and said suction passageway, a moveable member mounted in the socket in said valve body for movement between open and closed positions through intermediate positions between said open and closed positions, said moveable member having a connectable passageway having opposite ends adapted to connect between the ends of said inlet and outlet passageways with pairs of said ends in communication in said open and intermediate positions, to be spaced from at least one of the ends of said inlet and outlet passageways in said closed position so that in said closed position said moveable member blocks communication between said inlet and outlet passageways in said valve body, and adapted to have decreasing portions of the areas of said pairs of said ends in communication during movement of said moveable member through said intermediate positions from said open position toward said closed position; and means for connecting the inlet passageway in the valve body to a reservoir containing a liquid coating material to be sprayed;

one of said ends in each of said pairs of ends having a shape adapted to increase the angle of rotation required to rotate the rotary member from its open portion through its intermediate positions to its closed position and to afford more accurate adjustment of the rotary member to allow small amounts of the material being sprayed to pass through the valve than would be possible if those pairs of ends both had circular shapes of the same diameter.

7. A spray assembly according to claim 6 wherein said passageway has a circular portion and a generally V-shaped portion projecting at one side of said circular portion of the passageway.

8. A spray assembly according to claim 6 wherein said one of said ends has a through air inlet passageway having an inlet opening through the surface of said moveable member that is open to the atmosphere when said moveable member is in said closed position, and an outlet opening positioned to communicate with said outlet passageway in said valve body in the closed position of said moveable member so that air will be drawn into said outlet passageway, said outlet opening being spaced from said outlet passageway in said valve body in the intermediate and open positions of said moveable member.

9. A spray assembly according to claim 8 wherein said valve includes means for sealing shut the inlet opening of said air inlet passageway against a surface of said valve body in said intermediate and open positions of said moveable member.

10. A spray assembly comprising:

a spray nozzle having an inlet end adapted to be coupled to a source of air under pressure, an outlet end, a through passageway between said ends, said through passageway having a portion of reduced passageway diameter between said ends, a suction passageway intersecting said through passageway adjacent said portion of reduced passageway diameter;

a valve comprising:

a valve body attached to said spray nozzle, said valve body having a socket and having separate inlet and outlet passageways, said inlet and outlet passageways having spaced ends communicating with said socket, and said outlet passageway communicating between said socket and said suction passageway, a moveable member mounted in the socket in said valve body for movement between open and closed positions through intermediate positions between said open and closed positions, said moveable member having a connectable passageway having opposite ends adapted to connect between the ends of said inlet and outlet passageways with pairs of said ends in communication in said open and intermediate positions, to be spaced from at least one of the ends of said inlet and outlet passageways in said closed position so that in said closed position said moveable member blocks communication between said inlet and outlet passageways in said valve body, and adapted to have decreasing portions of the areas of said pairs of said ends in communication during movement of said moveable member through said intermediate positions from said open position toward said closed position; and means for connecting the inlet passageway in the valve body to a reservoir containing a liquid coating material to be sprayed;

said moveable member having a through air inlet passageway having an inlet opening through the surface of said moveable member that is open to the atmosphere when said moveable member is in said closed position, and an outlet opening positioned to communicate with said outlet passageway in said valve body in the closed position of said moveable member so that air will be drawn into said outlet passageway, said outlet opening being spaced from said outlet passageway in said valve body in the intermediate and open positions of said moveable member.

11. A spray assembly according to claim 10 wherein said valve includes means for sealing shut the inlet opening of said air inlet passageway against a surface of said valve body in said intermediate and open positions of said moveable member.

12. In combination, a plurality of spray assemblies each comprising:

a spray nozzle having an inlet end adapted to be coupled to a source of air under pressure, an outlet end, a through passageway between said ends, said through passageway having a portion of reduced passageway diameter between said ends, a suction passageway intersecting said through passageway adjacent said portion of reduced passageway diameter;

a valve comprising:

a valve body attached to said spray nozzle, said valve body having a socket and having separate inlet and outlet passageways, said inlet and outlet passageways having spaced ends communicating with said socket, and said outlet passageway communicating between said socket and said suction passageway, a moveable member mounted in the socket in said valve body for movement between open and closed positions through intermediate positions between said open and closed positions, said moveable member having a connectable passageway having opposite ends adapted to connect between the ends of said inlet and outlet passageways with pairs of said ends in communication in said open and intermediate positions, to be spaced from at least one of the ends of said inlet and outlet passageways in said closed position so that in said closed position said moveable member blocks communication between said inlet and outlet passageways in said valve body, and adapted to have decreasing portions of the areas of said pairs of said ends in communication during movement of said moveable member through said intermediate positions from said open position toward said closed position;

a reservoir containing a liquid coating material to be sprayed; and a flexible hose having a through opening connected between the reservoir and the inlet passageway in the valve body; and a carrying tray including a platform supporting the reservoirs of said spray assemblies, and a support member adapted to support the spray nozzles and valves of said spray assemblies.

* * * * *